US008770209B2

(12) United States Patent
Kim et al.

(10) Patent No.: US 8,770,209 B2
(45) Date of Patent: Jul. 8, 2014

(54) COLOR HIGHLIGHTING COSMETICS CONTAINER INCLUDING A DETACHABLE MAKEUP BRUSH

(75) Inventors: You-Seob Kim, Incheon (KR); Hee-Young Kim, Incheon (KR); Shin-Bok Jung, Incheon (KR); Hae-Young Jung, Incheon (KR)

(73) Assignee: Yonwoo Co., Ltd., Incheon (KR)

( * ) Notice: Subject to any disclaimer, the term of this patent is extended or adjusted under 35 U.S.C. 154(b) by 0 days.

(21) Appl. No.: 13/699,292

(22) PCT Filed: May 17, 2011

(86) PCT No.: PCT/KR2011/003591

§ 371 (c)(1), (2), (4) Date: Nov. 20, 2012

(87) PCT Pub. No.: WO2011/149210

PCT Pub. Date: Dec. 1, 2011

(65) Prior Publication Data

US 2013/0061867 A1 Mar. 14, 2013

(30) Foreign Application Priority Data

May 25, 2010 (KR) ..... 10-2010-0048595

(51) Int. Cl.

| | |
|---|---|
| ***A45D 33/28*** | (2006.01) |
| ***A45D 40/24*** | (2006.01) |
| ***A45D 33/24*** | (2006.01) |
| ***A45D 33/26*** | (2006.01) |
| ***A45D 44/18*** | (2006.01) |
| ***A46B 15/00*** | (2006.01) |
| ***B65D 69/00*** | (2006.01) |
| ***B65D 83/10*** | (2006.01) |
| ***B65D 71/00*** | (2006.01) |

(52) U.S. Cl.

USPC ..... 132/297; 132/318; 132/294; 132/313; 206/581; 206/823; 206/362

(58) Field of Classification Search

USPC ..... 132/297, 76.5, 333, 286, 294, 295, 132/313–318, 320, 200, 120; 15/22.1, 15/143.1, 144.1, 145, 176.1, 167.1, 167.3; 206/581, 823, 235, 564, 385, 362, 472, 206/473, 229; 220/500, 507; D9/715, 718, D9/721, 723, 737, 739, 900; 16/406, 422; D28/73, 76, 77

See application file for complete search history.

(56) References Cited

U.S. PATENT DOCUMENTS 1,503,979 A * 8/1924 Callahan
1,730,555 A * 10/1929 Brennan ..... 132/316

(Continued)

FOREIGN PATENT DOCUMENTS

JP 2004-243015 A 9/2004
KR 20-0362273 Y1 9/2004

OTHER PUBLICATIONS

International Search Report for PCT/KR2011/003591 filed on May 17, 2011.

*Primary Examiner* — Vanitha Elgart

(57) ABSTRACT

The present invention relates to a color highlighting cosmetics container including a detachable makeup brush, and more particularly to a color highlighting cosmetics container including a body having a plurality of receiving grooves partitions for storing contents and a cover for closing/opening the body. The body includes a plurality of brushes, a brush supporter from which the plurality of brushes is detachable, and brush-receiving grooves and a brush-supporter-receiving groove on which the plurality of brushes and the brush supporters are mounted, respectively. As a result, the plurality of brushes are detachable from the brush supporter. Therefore, the brushes can be replaced using the brush supporter.

8 Claims, 4 Drawing Sheets

(56) References Cited

U.S. PATENT DOCUMENTS

| | | | | | |
|---|---|---|---|---|---|
| 2,426,418 | A * | 8/1947 | Seaver | 15/176.1 |
| 2,748,414 | A * | 6/1956 | Glunt | 15/226 |
| 2,823,681 | A * | 2/1958 | Miller | 132/295 |
| 3,759,375 | A * | 9/1973 | Nappi | 206/362 |
| 4,471,874 | A * | 9/1984 | Morane | 206/581 |
| 4,562,923 | A * | 1/1986 | Katada et al. | 206/235 |
| 5,107,984 | A * | 4/1992 | Welschoff | 206/751 |
| 5,586,653 | A * | 12/1996 | Taveroff | 206/362 |
| 5,992,423 | A * | 11/1999 | Tevolini | 132/200 |
| 6,039,052 | A * | 3/2000 | Choi | 132/313 |
| 6,237,612 | B1 * | 5/2001 | Heyer | 132/294 |
| 6,450,179 | B2 * | 9/2002 | Bengis | 132/297 |
| 6,502,585 | B1 * | 1/2003 | Mazzei et al. | 132/237 |
| 6,510,578 | B1 * | 1/2003 | Cyr et al. | 15/176.6 |
| 6,796,431 | B1 * | 9/2004 | Goldring | 206/581 |
| 6,886,571 | B2 * | 5/2005 | Takeda | 132/318 |
| 6,886,695 | B1 * | 5/2005 | Karoly | 206/581 |
| 8,066,014 | B2 * | 11/2011 | Deris | 132/102 |
| 8,074,666 | B2 * | 12/2011 | Piao | 132/313 |
| 8,132,285 | B2 * | 3/2012 | Piao | 15/184 |
| 8,371,313 | B2 * | 2/2013 | Piao | 132/313 |
| 2003/0046780 | A1 * | 3/2003 | Davis | 15/167.1 |
| 2003/0145872 | A1 * | 8/2003 | Takeda | 132/313 |
| 2004/0168700 | A1 * | 9/2004 | Dorf | 132/313 |
| 2004/0200748 | A1 * | 10/2004 | Klassen et al. | 206/368 |
| 2008/0105274 | A1 * | 5/2008 | Kennedy | 132/210 |
| 2008/0283083 | A1 * | 11/2008 | Piao | 132/317 |
| 2008/0302383 | A1 * | 12/2008 | de Montjamont | 132/287 |
| 2010/0095973 | A1 * | 4/2010 | Shrier et al. | 132/200 |
| 2010/0300470 | A1 * | 12/2010 | Richardson | 132/120 |
| 2012/0055505 | A1 * | 3/2012 | Piao | 132/313 |
| 2012/0125362 | A1 * | 5/2012 | Irving et al. | 132/314 |
| 2012/0260931 | A1 * | 10/2012 | Martin et al. | 132/200 |
| 2013/0014338 | A1 * | 1/2013 | Park | 15/176.6 |
| 2013/0125921 | A1 * | 5/2013 | Celia | 132/313 |

* cited by examiner

Figure 1 <PRIOR ART>
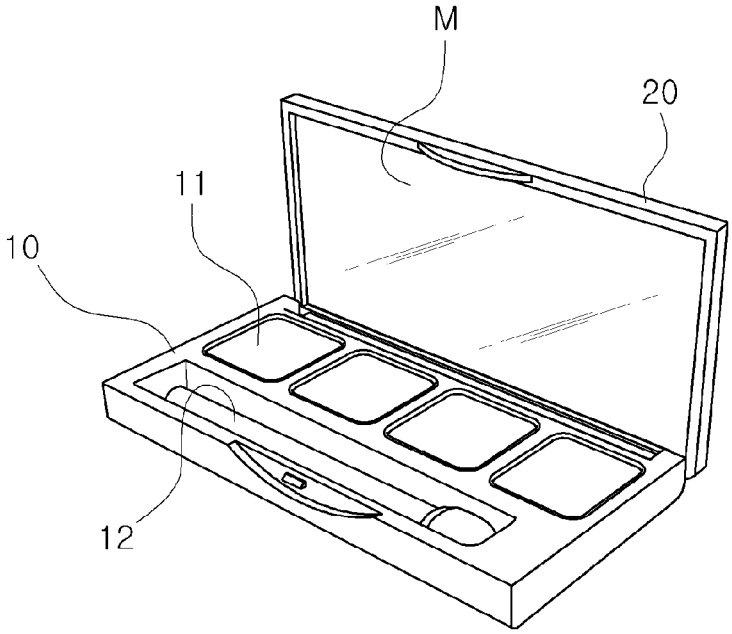
Figure 2
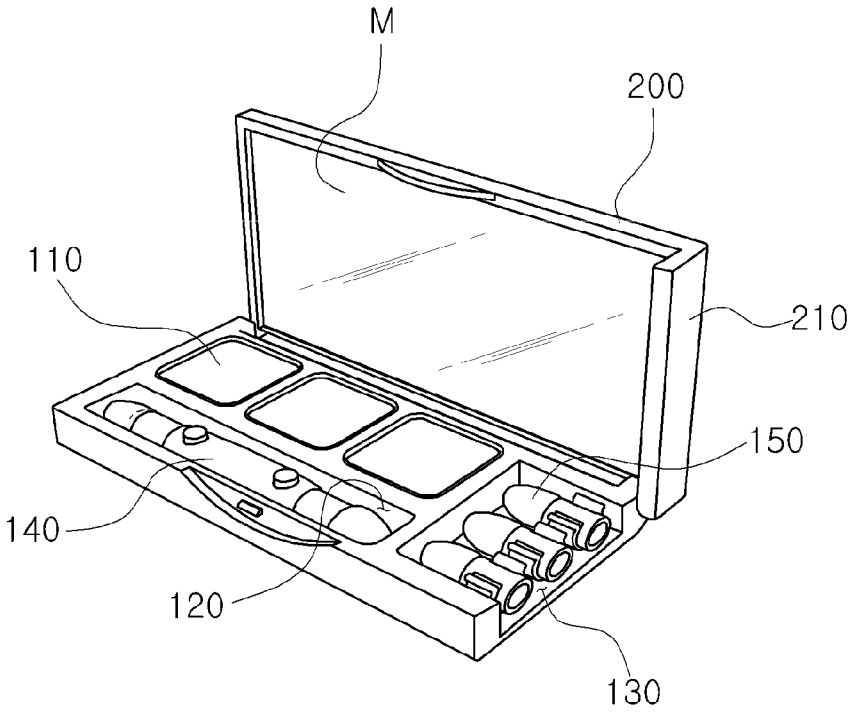

COLOR HIGHLIGHTING COSMETICS CONTAINER INCLUDING A DETACHABLE MAKEUP BRUSH

TECHNICAL FIELD

The present invention relates to a color highlighting cosmetics container including a detachable makeup brush, and in particular to a color highlighting cosmetics container including a detachable makeup brush which has features in that a brush is detachable from a brush support part, so a user can exchange only a brush if needed, thus enhancing the portability of cosmetics.

BACKGROUND ART

As the modern society rapidly diversifies, men and women of all ages tend to use cosmetics. In particular, women are using various kinds of cosmetics and cosmetics with different tones and tools. Thanks to the developments from related industries, various kinds of quality cosmetics and tools are being launched on the markets.

The tone makeup is generally performed for the purpose of obtaining further makeup effects after a basic makeup, so it can be called as a practical makeup performed in consideration of beauty, colors, trends, etc. Such makeup might generate different effects depending on the usage and skill.

The above mentioned tone cosmetics might be classified into a skin expression cosmetics using a makeup base, a foundation and a powder, an eye cosmetics using an eye shadow, an eye liner, an eye blower, a mascara, a lip cosmetics using a lipstick, a lip gloss, a lip cream, and a cheek touch cosmetics which is used during a tone makeup on cheeks and jaw. Among such tone cosmetics, there are a lipstick or an eye shadow pencil type, a cake type and a cream type. In case of the cake type and the cream type, various tone cosmetics materials are accommodated in one case, so there are most preferred. In the interior of the accommodation case are provided a makeup brush along with tone makeup materials.

As shown in FIG. 1, the conventional tone cosmetics case such as a lipstick or an eye shadow used for the sake of a tone makeup comprise a body 10 configured in such a way that different kinds of tone makeup materials are accommodated in a plurality of accommodation parts 11, and at one side of the body 10 is accommodated a makeup brush 12, and a cover 20 which is hinged at the body and is foldable at a certain angle and has a mirror "M" at an inner side surface.

When the conventional tone cosmetics container is used, the user opens the cover while holding the handle part of the makeup brush and has the brush sucking a certain amount of makeup materials and then performs, using a desired color, a makeup looking into the mirror disposed on the inner surface of the cover. When the user finishes the makeup, the makeup brush is accommodated into a corresponding place of the body for the sake of storage.

The conventional tone cosmetics container is generally designed for a user to perform a makeup with the tone makeup materials of different colors accommodated in the accommodation part using only one makeup brush, so the tone makeup materials of each color might be repeatedly used. In this case, the colors of the tone makeup materials might change. In order to prevent the above problems, it is necessary to provide a plurality of makeup brushes which are needed for each color, so the user can feel hard to carry such container.

DISCLOSURE OF INVENTION

Accordingly, the present invention is made to improve the above explained problems. It is an object of the present invention to provide a color highlighting cosmetics container including a detachable makeup brush with a detachable and easy-to-carry brush featuring in that a brush is detachable from a brush support part, so a user can exchange only the brush if needed.

It is another object of the present invention to provide a color highlighting cosmetics container including a detachable makeup brush featuring in that a brush is detachable from a brush support part, and a user can carry a set of desired brushes in one tone cosmetics container, which makes a user feel easy when using the brushes.

To achieve the above described objects, there is provided a color highlighting cosmetics container including a detachable makeup brush, comprising a body having a plurality of accommodation grooves each storing stuff; and a cover opening and closing the body, and in the body are accommodated a plurality of brushes and brush support parts to which are detachably engaged the brushes, and the brushes and the brush support part are accommodated in a brush accommodation groove, and a brush support accommodation groove is formed.

In addition, the brush support part comprises a handle part having a certain length and a hollow part; a brush engagement part which is extended from both sides of the handle part and to which a brush is engaged, while comprising a cut-away part formed as part of it is cut away, and a protrusion part upwardly protruded from an end portion of the cut-away part for fixing the brush; and a button part which is formed at both sides of the handle part and serves to pressurize the cut-away part of the brush engagement part.

A protrusion part surrounding the outer surface is formed at a lower side of the brush, and a brush fixing groove to which is engaged the protrusion part is formed in the brush accommodation groove.

In the brush accommodation groove is provided a brush fixing part the upper side of which is open and is formed in a circular shape, while providing an elastic force in an inward direction, thus fixing a plurality of the brushes.

ADVANTAGEOUS EFFECTS

As explained above, the present invention has features in that the brush is detachable from the brush support part, so the user can exchange only the brush if needed, so it is easy to carry.

Since the brush is detachable from the brush support part, the user can carry a set of different brushes in one tone cosmetics container, so the user can have enhanced conveniences.

BRIEF DESCRIPTION OF DRAWINGS

FIG. 1 is a perspective view illustrating a construction of a conventional tone cosmetics container with a makeup brush.

FIG. 2 is a disassembled perspective view illustrating a construction of a color highlighting cosmetics container including a detachable makeup brush according to a preferred embodiment of the present invention.

BEST MODES FOR CARRYING OUT THE INVENTION

Figure 3:
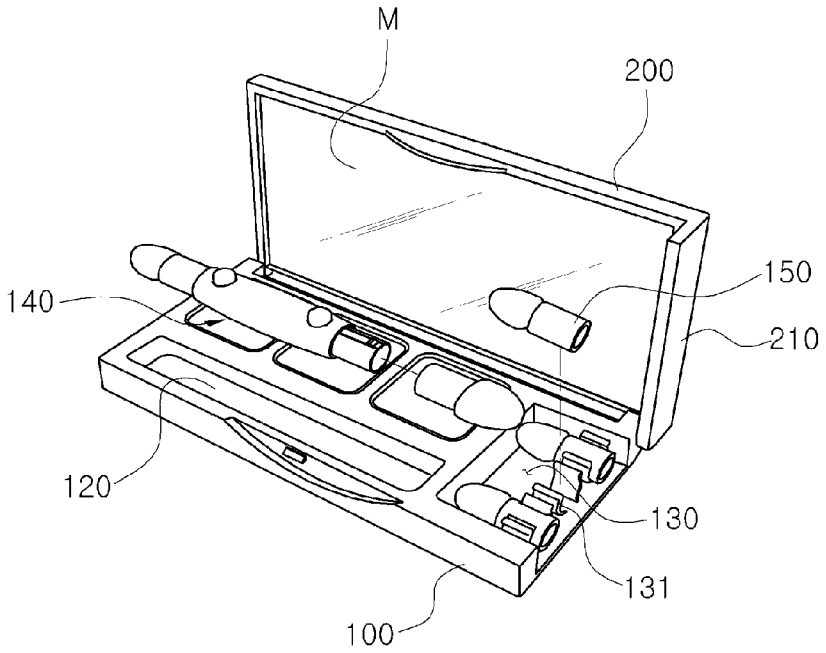
FIG. 3 is a perspective view illustrating an engaged construction of a color highlighting cosmetics container including a detachable makeup brush according to a preferred embodiment of the present invention.

The present invention will be described in details with reference to the accompanying drawings. The same reference numerals in each drawing represent the same elements.

Figure 4:
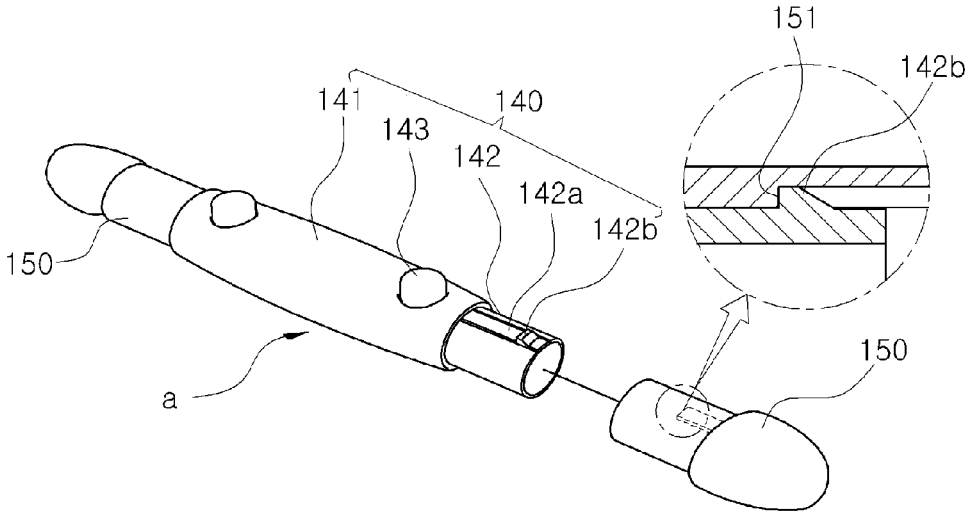
FIGS. 4 and 5 are views illustrating a detaching procedure of a brush and a brush support part of a color highlighting cosmetics container including a detachable makeup brush according to a preferred embodiment of the present invention.
Figure 5:
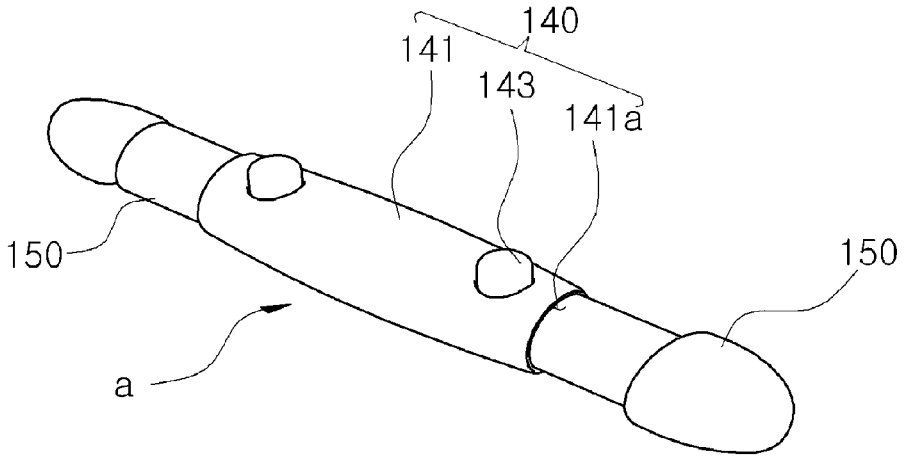

FIG. 2 is a disassembled perspective view illustrating a construction of a color highlighting cosmetics container including a detachable makeup brush according to a preferred embodiment of the present invention. FIG. 3 is a perspective view illustrating an engaged construction of a color highlighting cosmetics container including a detachable makeup brush according to a preferred embodiment of the present invention. FIGS. 4 and 5 are views illustrating a detaching procedure of a brush and a brush support part of a color highlighting cosmetics container including a detachable makeup brush according to a preferred embodiment of the present invention.

As shown in FIGS. 2 to 5, the tone cosmetics container having a makeup brush with a detachable brush according to a preferred embodiment of the present invention comprises a body 100 and a cover 200.

The body 100 is formed of a plurality of accommodation grooves 110 which are configured to store stuff. A makeup brush "a" is provided in the body 10 for the user to use the stuffs stored in the accommodation grooves 110.

In the present invention, the makeup brush "a" is configured in such a way that the brush tip 150 can be detachable from the brush support part 140. So, the user can selectively exchange the brush tips 150 depending on different colors while the user performs a makeup using the stuffs made in different colors.

In the body 100 are provided a plurality of brush tip accommodation grooves 130 accommodating a plurality of brush tips 150 so that the user can selectively use the brush tips 150. It is preferred that the brush fixing parts 131 are provided in the brush tip accommodation grooves 130 for the purpose of fixing the brush tips 150. The brush fixing part 131 is formed in a circular shape the upper side of which is open, and is configured to provide an elastic force in the inward direction. So, the upper sides of the brush fixing part 131 are widen in both directions when engaging the brush tip 150 and are narrowed after the engagement of the brush tip 150 is finished, thus fixing the brush tip 150.

The brush support accommodation groove 120 is formed in the body 100 for the purpose of accommodating the brush support parts 140 to which are detachably engaged the brush tips 150. The brush support part 140 comprises a handle part 141, a brush engaging part 142 and a button part 143.

The handle part 141 has a certain handle long enough for a user to easily grasp, and has a hollow hole 141*a* for the sake of the engagement with the brush engagement part 142, and at both upper sides of the same are provided a button engagement hole 141*b* for the sake of the engagement with the button part 143.

The brush engagement part 142 is extended toward both sides of the handle part 141 for the sake of the engagement of the brush tip 150, and part of the brush engagement part 142 is cut away for the sake of the detachment of the brush tip 150. A cut-away part 142*a* moves upward and downward depending on the pressure of the button part 143. At an end portion of the cut-away part 142*b* is formed an upwardly protruded protrusion 142*b* for fixing the brush tip 150. It is preferred that an accommodation shoulder 151 is formed at an inner side of the brush tip 150 for accommodating the protrusion 142*b*.

The button part 143 is formed at both upper sides of the handle part 141 for the purpose of pressurizing the cut-away part 142*a* of the brush engagement part 142 as the user pressurizes. When it is intended to detach the brush tip 150, the button part 143 is pressurized, and the button part 143 moves the cut-away part 142*a* in the downward direction. At this time, the protrusion 142*b* formed at an end portion of the cut-away part 142*a* moves downward along with the cut-away part 142*a* and escapes from the accommodation shoulder formed at the inner side of the brush tip 150, thus allowing the brush tip 150 to escape.

The cover 200 serves to open and close the body 100 as it is hinged at one side of the body 100. It is preferred that a mirror "M" is provided on an inner side of the cover 200 for the user to see a makeup portion during the makeup.

It is preferred that the cover 200 has an extension part 210, the side part of which contacting with the brush tip accommodation groove 130 is downwardly prolonged, for the purpose of closing the side part of the brush tip accommodation groove 130.

The tone cosmetics container having a makeup brush with a detachable brush according to another embodiment of the present invention will be described.

Figure 6:
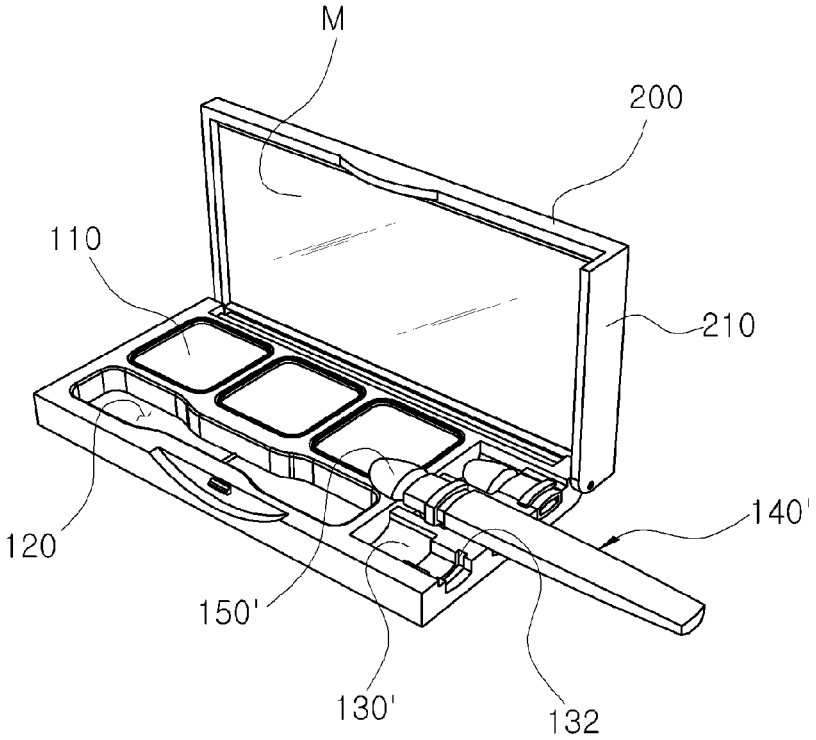
FIGS. 6 to 8 are perspective views illustrating a construction of a color highlighting cosmetics container including a detachable makeup brush according to another embodiment of the present invention.
Figure 7:
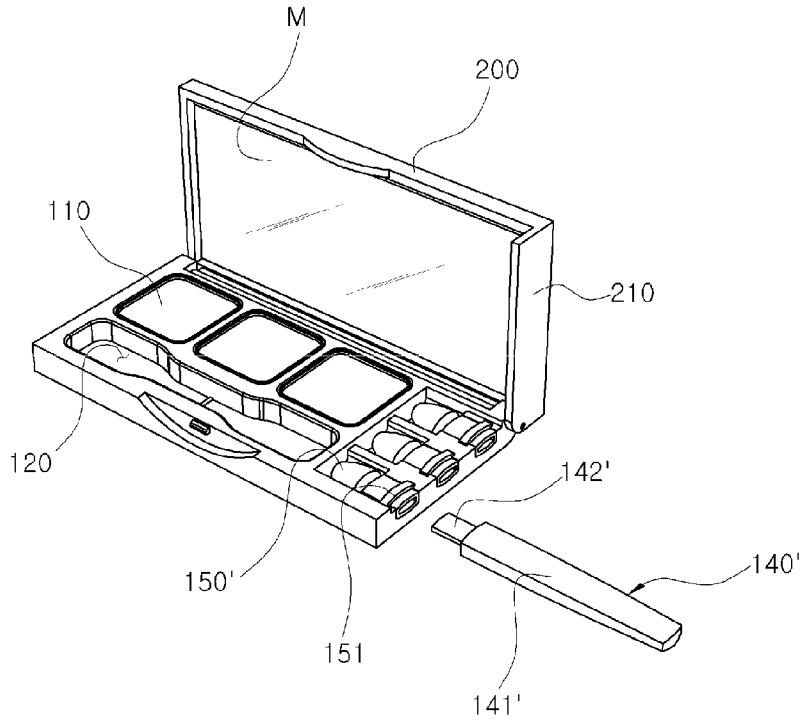
Figure 8:
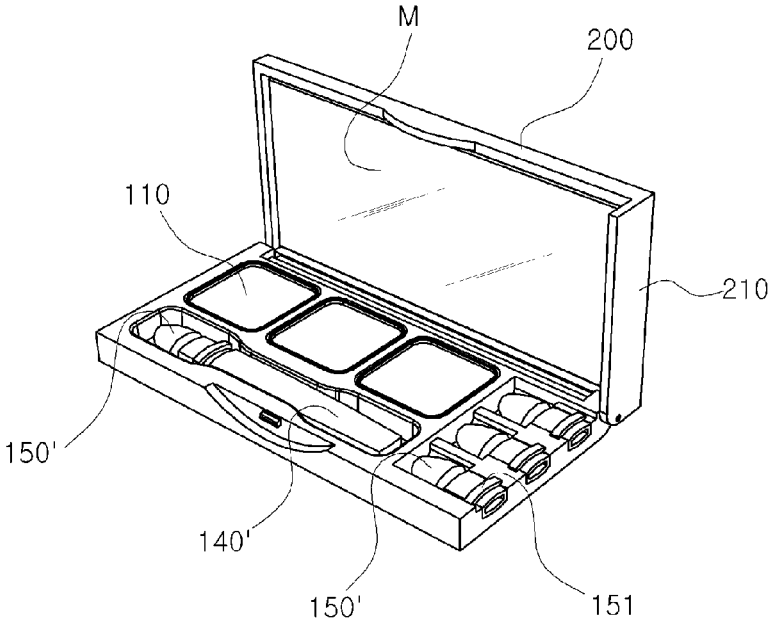

As shown in FIGS. 6 to 8, the tone cosmetics container having a makeup brush with a detachable brush according to another embodiment of the present invention is directed to providing a structure facilitating an easier engagement and disengagement of a brush support part 140' and a brush tip 150'. The brush support part 140' comprises a handle part 141' having a certain length long enough for a user to easily grasp, and a brush engagement part 142' which is extended from one side end of the handle part 141' and to which the brush tip 150' is engaged. So, it can be easily engaged with the brush 150' by a sliding method.

In addition, the brush tip 150' has a protrusion part 151 formed at its lower side while surrounding the outer surface. The brush tip accommodation groove 130' has a brush fixing groove 132 corresponding to the protrusion 151 for the protrusion part 151 to be engaged, thus fixing the brush tip 150' when the brush tip 150' is engaged in the brush tip accommodation groove 130'.

The brush tip accommodation groove 130' serves to prevent the brush tip 150' from moving forward, backward, leftward or rightward when engaging the brush tip 150'. When a user engages the brush support part 140' to the brush tip 150' and moves the brush support part 140' in the upward direction, the brush tip 150' can escape from the brush fixing groove 132 for the sake of use.

In addition, it is preferred that the brush tip accommodation groove 130' is provided in multiple numbers at regular intervals so that the multiple brush tips 150' can be accommodated.

As the present invention may be embodied in several forms without departing from the spirit or essential characteristics thereof, it should also be understood that the above-described examples are not limited by any of the details of the foregoing description, unless otherwise specified, but rather should be construed broadly within its spirit and scope as defined in the appended claims, and therefore all changes and modifications that fall within the meets and bounds of the claims, or equivalences of such meets and bounds are therefore intended to be embraced by the appended claims.

The invention claimed is:

1. A color highlighting cosmetics container including a detachable makeup brush, comprising:

a plurality of detachable brush tips each having an engagement end and a brush end;

a brush support; and a container having a body and a cover connected with a hinge to facilitate an open position and a closed position, wherein the body has a top, a bottom and at least three sides and includes a plurality of grooves storing a plurality of cosmetics, a brush support accommodation groove storing the brush support detachably engaged to a brush tip, and a plurality of brush tip accommodation grooves storing the plurality of detachable brush tips, and open at the top and a side of the body, and wherein the brush support includes a hollow handle having a top side and a bottom side, a first and second end, and a hole near each of the top side of the first and second ends of the handle, a depressible button that protrudes through each of the holes near the first and second ends of the handle, wherein the buttons may be depressed in a downward direction, and a brush engagement part seated in each of the first and second ends of the handle and extending outward, wherein each brush engagement part includes a cut-away having an upward protrusion formed near the outward end of the brush engagement part, and wherein the cut-away and the protrusion are configured to move in a downward direction relative to the brush engagement part and to the top side of the handle when the button is depressed, wherein the brush engagement part protrusion engages the brush tip to attach the brush tip to the brush support, and wherein the brush tip is detached by pressing the button in a downward direction.

2. The container including a detachable makeup brush of claim 1, wherein in each of the plurality of brush tip accommodation grooves includes a brush fixing part, wherein each brush fixing part includes a pair of elastic semi-circular shapes extending from the bottom of the brush tip accommodation groove upward toward the top of the body, wherein the pair of semi-circular shapes is configured to form a circular shape and to form an opening near the top of the body to allow insertion and removal of the engagement end of a brush tip, and wherein the pair of semi-circular shapes is configured to provide an elastic force towards the inside of the circular shape to retain and store the brush tip.

3. The container including a detachable makeup brush of claim 2, wherein the pair of semi-circular shapes widen away from the inside of the circular shape when engaging the engagement end of the brush tip and narrow towards the inside of the circular shape when the brush tip is fixed in the brush tip accommodation groove.

4. The container including a detachable makeup brush of claim 2, wherein the cover includes an extension part configured to cover the top and side of the plurality of brush tip accommodation grooves when the container is in a closed position.

5. The container including a detachable makeup brush of claim 1, wherein the brush tip includes an accommodation shoulder formed inside the engagement end of the brush tip, and wherein the accommodation shoulder is configured to engage the brush engagement part protrusion.

6. The container including a detachable makeup brush of claim 5, wherein the accommodation shoulder and the brush engagement part protrusion are disengaged when the button is depressed in a downward direction.

7. A color highlighting cosmetics container including a detachable makeup brush, comprising:

a plurality of detachable brush tips each having a hollow engagement end and a brush end, wherein a protrusion part is formed around an exterior of the engagement end;

a brush support; and a container having a body and a cover connected with a hinge to facilitate an open position and a closed position, wherein the body has a top, a bottom and at least three sides and includes a plurality of grooves storing a plurality of cosmetics, a brush support accommodation groove storing the brush support detachably engaged to a brush tip, and a plurality of brush tip accommodation grooves storing the plurality of detachable brush tips, and open at the top and a side of the body, wherein the plurality of brush tip accommodation grooves include a plurality of indentations corresponding to the shapes of the plurality of brush tips in order to retain the brush tips, wherein the plurality of indentations prevents the plurality of brush tips from moving in forward, backward, leftward or rightward relative to the plurality of brush tip accommodation grooves when the brush tip is engaged in the brush tip accommodation groove, wherein the brush support includes a handle and a tongue configured to slide into the hollow engagement end of a brush tip, and wherein a brush tip engaged in the brush tip accommodation groove is removed in an upward direction after attachment to the brush support.

8. The container including a detachable makeup brush of claim 7, wherein the cover includes an extension part configured to cover the top and side of the plurality of brush tip accommodation grooves when the container is in a closed position.

* * * * *